US011208831B2

(12) United States Patent
Kamata et al.

(10) Patent No.: US 11,208,831 B2
(45) Date of Patent: Dec. 28, 2021

(54) LUGGAGE LOCK DEVICE

(71) Applicant: Toyota Jidosha Kabushiki Kaisha, Toyota (JP)

(72) Inventors: Nobuhide Kamata, Susono (JP); Yasuo Uehara, Gotemba (JP); Nozomu Hatta, Susono (JP); Shunsuke Tanimori, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 77 days.

(21) Appl. No.: 16/738,454

(22) Filed: Jan. 9, 2020

(65) Prior Publication Data

US 2020/0224466 A1 Jul. 16, 2020

(30) Foreign Application Priority Data

Jan. 15, 2019 (JP) ..... JP2019-004596

(51) Int. Cl.

| | |
|---|---|
| ***E05B 83/16*** | (2014.01) |
| ***E05B 49/00*** | (2006.01) |
| ***G07C 9/00*** | (2020.01) |
| ***E05B 65/52*** | (2006.01) |

(52) U.S. Cl.

CPC ..... *E05B 83/16* (2013.01); *E05B 49/00* (2013.01); *E05B 65/52* (2013.01); *G07C 9/00563* (2013.01); *G07C 9/00896* (2013.01)

(58) Field of Classification Search

CPC ..... G07C 9/00; E05B 83/16

See application file for complete search history.

(56) References Cited

U.S. PATENT DOCUMENTS

| | | | | |
|---|---|---|---|---|
| 10,550,608 | B2 * | 2/2020 | Lam | E05B 63/0065 |
| 2019/0017294 | A1 * | 1/2019 | Sternlight | G07C 9/00309 |
| 2019/0103028 | A1 | 4/2019 | Kobayashi et al. | |

FOREIGN PATENT DOCUMENTS

| | | | |
|---|---|---|---|
| JP | 2017-182137 | A | 10/2017 |

* cited by examiner

*Primary Examiner* — K. Wong

(74) *Attorney, Agent, or Firm* — Dinsmore & Shohl LLP

(57) ABSTRACT

A luggage lock device includes: a plurality of luggage lock mechanisms able to store luggage of a user of a vehicle so that when locked, the luggage is restricted from being taken out; and a luggage lock control device connected to the plurality of luggage lock mechanisms. The luggage lock control device is configured to: control the plurality of luggage lock mechanisms; acquire a destination of a user; and recognize a user who stowed luggage in the luggage lock mechanism and the luggage lock mechanism in which the user stowed the luggage, and wherein the luggage lock control device is configured to unlock a luggage lock mechanism storing luggage of the user arriving at the destination when the vehicle reaches the destination of the user.

8 Claims, 6 Drawing Sheets

LUGGAGE LOCK DEVICE

CROSS-REFERENCE TO RELATED APPLICATIONS

This application claims priority to Japanese Patent Application No. 2019-004596 filed Jan. 15, 2019, which is incorporated herein by reference in its entirety including the specification, drawings, and abstract.

FIELD

The present disclosure relates to a luggage lock device.

BACKGROUND

In recent years, technology for using autonomously driven vehicles for vehicles used for taxi services, bus services, shared ride services, and other mobility services has been proposed (for example, see PTL 1). For example, PTL 1 discloses an on-demand bus which operates in response to request for use by users.

CITATIONS LIST

Patent Literature

[PTL 1] Japanese Patent Publication No. 2017-182137

SUMMARY

Technical Problem

In this regard, in an automated driving vehicle utilized by a plurality of users, sometimes the luggage of the users will be placed at locations not able to be watched by the users. Therefore, when a user get off, the getting-off user is liable to end up mistakenly or deliberately taking off with the luggage of another user.

To keep luggage from being carried off with in this way, it may be considered to provide the automated driving vehicle with luggage lock mechanisms enabling luggage to be stowed such that removal of the luggage is restricted in a locked slate. For example, when getting on, a user stows his or her luggage in a luggage lock mechanism, then Socks the luggage lock mechanism to thereby keep that luggage from being carried off.

However, in such a luggage lock mechanism, when the user unlocks the luggage lock mechanism so as to take out the luggage when getting off, for example, the user has to perform some sort of operation such as entering a PIN or holding a mobile terminal near a reading device. If a user has to perform such an operation when being getting off, the user will be inconvenienced when taking out the luggage.

In view of this problem, an object of the present disclosure is to reduce the trouble required for a user to take out luggage when getting off and thereby improve the convenience of a luggage lock system mounted in a vehicle.

Solution to Problem

The gist of the present disclosure is as follows:

(1) A luggage lock device comprising:

a plurality of luggage lock mechanisms able to store luggage of a user of a vehicle so that when locked, the luggage is restricted from being taken out; and a luggage lock control device connected to the plurality of luggage lock mechanisms, the luggage lock control device being configured to:

control the plurality of luggage lock mechanisms;

acquire a destination of a user; and recognize a user who stowed luggage in the luggage lock mechanism and the luggage lock mechanism in which the user stowed the luggage, wherein the luggage lock control device is configured to unlocks a luggage lock mechanism storing luggage of the user arriving at the destination when the vehicle reaches the destination of the user.

(2) The luggage lock device according to the above (1), wherein the luggage lock device further comprises a recognition device recognizing the user, the recognition device is provided so as to correspond to each luggage lock mechanism, and the luggage lock control device is configured to recognize a user recognized by the recognition device as a user storing luggage in a luggage lock mechanism corresponding to die recognition device.

(3) The luggage lock device according to the above (1), wherein the luggage lock device further comprises a communication device configured to be able to communicate with a mobile terminal of the user, and the luggage lock control is configured, when receiving an unlock request sent from the mobile terminal of the user through the communication device, to unlock the luggage lock mechanism in which the user stowed the luggage even before the vehicle reaches the destination of the user.

(4) The luggage lock device according to the above (1), wherein the luggage lock control device is configured to notify a user reaching the destination of the fact of the luggage lock mechanism storing the luggage of the user reaching the destination being unlocked, when the vehicle has reached the destination of the user.

(5) A method for controlling a plurality of luggage lock mechanisms able to store luggage of a user of a vehicle so that when locked, the luggage is restricted from being taken out, the method comprising steps of:

acquiring a destination of the user;

recognizing a user who stowed luggage in the luggage lock mechanism and the luggage lock mechanism in which the user stowed the luggage; and unlocking a luggage lock mechanism storing luggage of the user arriving at the destination, when the vehicle reaches the destination of the user.

According to the present disclosure, it become possible to reduce the trouble required for a user to take out luggage when getting off and thereby improve the convenience of a luggage lock system mounted in a vehicle.

DESCRIPTION OF EMBODIMENTS

Figure 1:
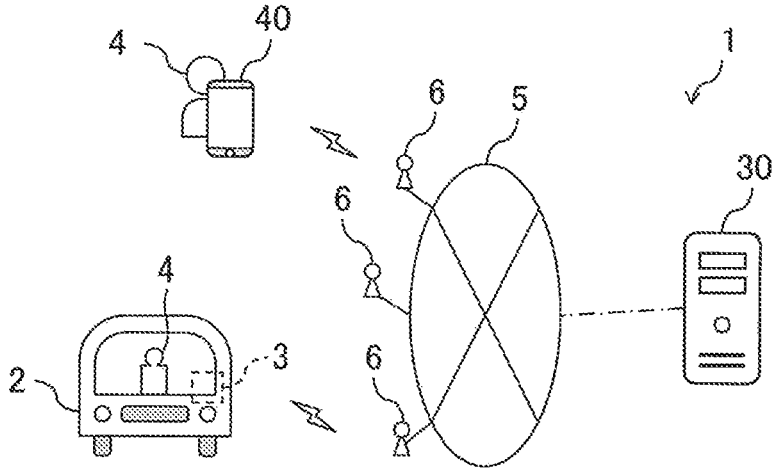
FIG. 1 is a view showing one example of the configuration of a user transport system according to one embodiment.

Below, referring to the drawings, embodiments of the present disclosure will be explained in detail. Note that, in the following explanation, similar component elements are assigned the same reference notations.

Overall Configuration of User Transport System

FIG. 1 is a view showing one example of the configuration of a user transport system 1 according to the present embodiment. The user transport system 1 provides a bus service, shared ride service, or other mobility service. As shown in FIG. 1, the user transport system 1 according to the present embodiment includes an in-vehicle device 3 mounted in a vehicle 2, a server 30, and a mobile terminal 40.

In the present embodiment, the vehicle 2 is an automated driving vehicle providing mobility service in which a plurality of users 4 share a ride, such as a bus service or shared ride service, etc. In particular, in the present embodiment, the vehicle 2 is an automated unmanned driven vehicle with no driver or other attendant.

The server 30, for example, is connected through a not shown gateway etc. to a network 5. Further, the in-vehicle device 3 of the vehicle 2 and the mobile terminal 40 are, for example, connected with the network 5 through a wireless base station 6 etc.

Overall Configuration of Vehicle

Figure 2:
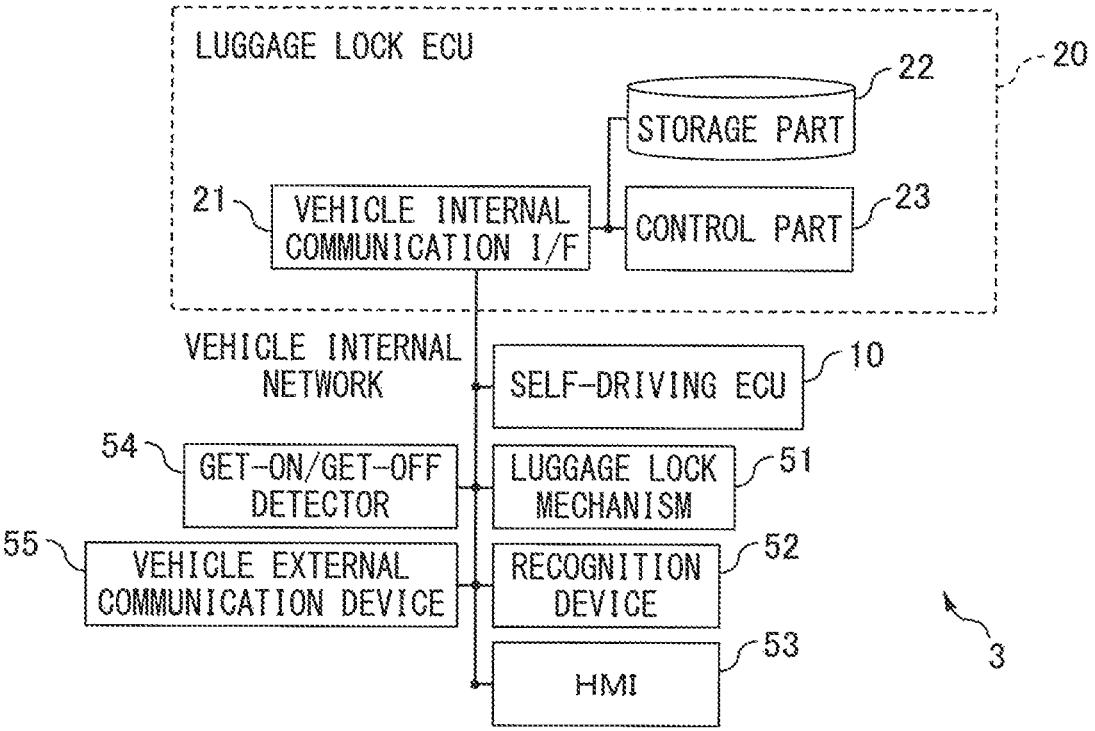
FIG. 2 is a schematic view of the configuration of a vehicle according to one embodiment.

FIG. 2 is a schematic view of the configuration of an in-vehicle device 3 of a vehicle 2 according to the present embodiment. As shown in FIG. 2, the in-vehicle device 3 includes a self-driving electronic control unit (ECU) 10, luggage-locking ECU 20, luggage lock mechanism 51, recognition device 52, HMI (human machine interfaces) 53, a get-on/get-off detector 54, and vehicle outside communication device 55, which are connected with each other through a vehicle internal network. The vehicle internal network, for example, is a network based on the CAN (controller area network) standard. The in-vehicle device 3 is one example of a luggage lock system according to the present embodiment.

The self-driving ECU 10 outputs control signal for control of automated driving of the vehicle 2 based on surrounding information of the vehicle 2 (for example, information on a white line of a road, other vehicles, pedestrians, obstacles, etc.), vehicle status information, position information indicating the current location of the vehicle 2, and the driving route of the vehicle 2. The surrounding information of the vehicle 2 is, for example, acquired from an outside camera, milliwave radar, LIDAR (Laser Imaging Detection and Ranging) device, ultrasonic wave sensor (all not shown), or other detection device. The vehicle status information is, for example, acquired from a vehicle speed sensor, yaw rate sensor, door operation sensor (all not shown), etc. The position information of the vehicle 2 is acquired from a GPS (Global Positioning System) of a not shown car navigation system installed in the vehicle 2. The driving route is, for example, acquired from the server 30. The self-driving ECU 10 performs processing relating to the vehicle 2 in the processing for user transport relating to the mobility service explained later using FIG. 7.

The luggage-locking ECU 20 has a vehicle internal communication interface (I/F) part 21, storage part 22, and control part 23, which are connected with each other through signal wires.

The vehicle internal communication I/F part 21 is a communication I/F circuit for the luggage-locking ECU 20 to communicate with other in-vehicle devices of the vehicle 2 through the vehicle internal network.

The storage part 22, for example, can include a ROM (read only memory), RAM (random access memory), etc. The storage part 22 stores the various programs and various data (for example, various parameters and various threshold values etc.) used for processing by the control part 23.

The control part 23, for example, can be a processor having a CPU and its peripheral circuits etc. The control part 23 can run the various programs stored in the storage part 22 to thereby perform the various control operations of the vehicle 2. The control part 23 is one example of a luggage lock control device according to the present embodiment.

The luggage lock mechanism 51 is configured to be able to store luggage 4*a* so that in the locked state, a user 4 is restricted from taking out the luggage 4*a*. The luggage lock mechanism 51 is locked or unlocked in accordance with a luggage lock signal or luggage unlock signal output from a luggage lock control part 24 described later. Each luggage lock mechanism 51 is, for example, given an identification number for the user 4 to identify the luggage lock mechanism 51.

As the luggage lock mechanism 51, for example, a wire lock type luggage lock mechanism configured to enable the two ends of a wire to be coupled or a luggage box type luggage lock mechanism having a door which can be opened and closed is used. In a wire lock type luggage Jock mechanism, for example, the luggage 4*a* is stowed in a state with a wire passed through the luggage 4*a* and the two ends of the wire coupled. By locking the two ends of the wire in this state, the user 4 is unable to detach the luggage 4*a* from the wire. The two ends of the wire can be unlocked to enable the user 4 to detach the luggage 4*a* from the wire. Further, in a luggage box type luggage lock mechanism, for example, the luggage 4*a* of the user 4 is placed in the luggage box of the luggage lock mechanism 51 and the door of the luggage box is closed. The luggage 4*a* is stored in this state. By locking the door of the luggage box in this state, the user 4 cannot take out the luggage 4*a* from the luggage box. The door of the luggage box can be unlocked to enable the user 4 to take out the luggage 4*a* from the luggage box.

The recognition device 52 recognizes a user 4. The recognition device 52, for example, is provided for each luggage lock mechanism 51 so as to correspond to each luggage lock mechanism 51. The recognition device 52 is configured to be able to recognize the user 4 stowing luggage 4*a* in the luggage lock mechanism 51 corresponding to that recognition device 52. The recognition device 52, for example, has a reading part for reading recognition information for recognizing the user 4 such as the ID of the user 4 stored in a mobile terminal 40, code information for user recognition displayed at the mobile terminal 40, biometric information such as the fingerprint of the user 4, etc. The read recognition information can be used to recognize the user 4 by a known method.

The HMI 53 is an interface for interacting information between an in-vehicle device 3 and a user 4. The HMI 53 is, for example, provided with a display for displaying information, a speaker for generating sound, operating buttons or a touch screen for a user to enter information or instructions, a microphone for picking up the voice of the user, etc. The HMI 53, for example, is provided for every seat of the vehicle 2, for every recognition device 52, and near the door of the vehicle.

When detecting get-on or get-off of a user 4, the get-on/get-off detector 54 outputs a get-on or get-off detection signal of the user 4 to the self-driving ECU 10 and luggage-locking ECU 20. The get-on/get-off detector 54, for example, can engage in short range wireless communication with a mobile terminal 40 of a user 4 to thereby detect get-on or get-off of the user 4.

The vehicle outside communication device 55 is an in-vehicle terminal having a wireless communication function. The vehicle outside communication device 55, for example, is an in-vehicle navigation system. DCM (Data Communication Module), fifth generation (5G) communication device, etc. The vehicle outside communication device 55 is connected through a wireless base station 6 to the network 5. The vehicle outside communication device 55 is one example of a communication device according to the present embodiment.

Figure 3:
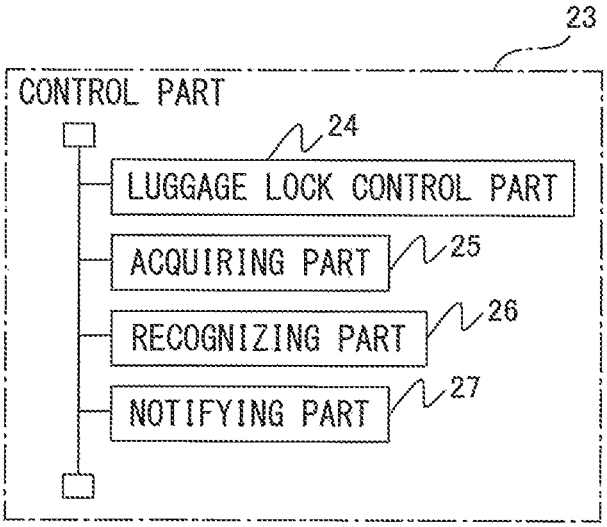
FIG. 3 is a functional block diagram of a control part of an in-vehicle device according to one embodiment.

FIG. 3 is a functional block diagram of a control part 23 of a luggage-locking ECU 20 according to the present embodiment. As shown in FIG. 3, the control part 23 includes a plurality of functional modules loaded by programs run on the processor of the control pan 23. As shown in FIG. 2, in the present embodiment, the control part 23 includes, as functional modules, a luggage lock control part 24, acquiring part 25, recognizing part 26, and notifying part 27.

The luggage lock control part 24 is connected to the plurality of luggage lock mechanisms 51 and sends luggage lock signals or luggage unlock signals to the luggage lock mechanism 51 to thereby control the locking and unlocking of the luggage lock mechanism 51. The acquiring part 25 acquires the destination of a user 4. The recognizing part 26 recognizes a user 4 who stowed luggage 4*a* at a luggage lock mechanism 51 and the luggage lock mechanism 51 at which that user 4 stowed that luggage 4*a*. The notifying part 27 makes various notifications to the user 4.

Figure 4:
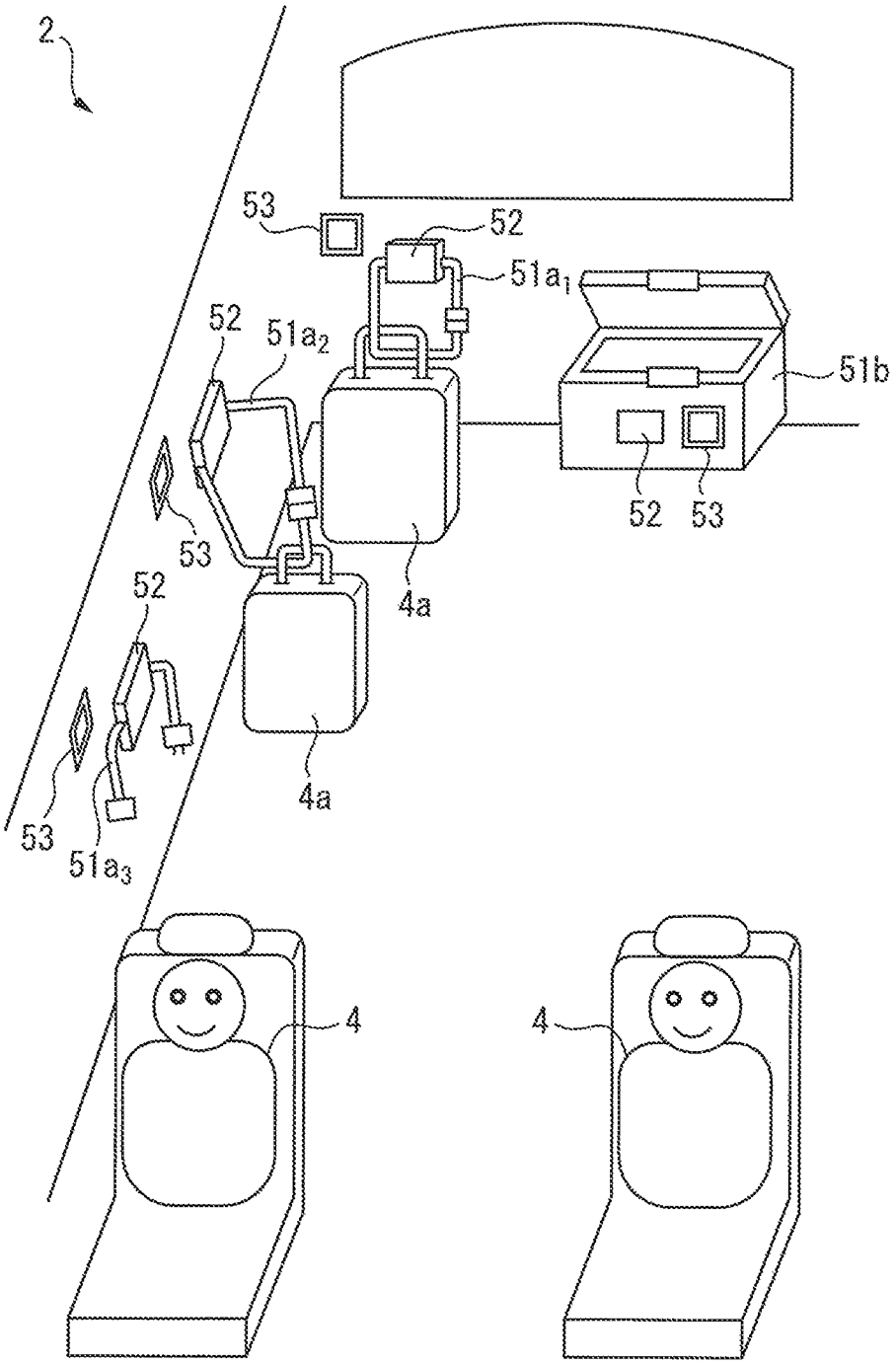
FIG. 4 is a view showing an example of a state inside a vehicle according to one embodiment.

FIG. 4 is a view showing one example of the state inside of a vehicle 2 according to the present embodiment. In the example shown in FIG. 4, the back part of the inside of the vehicle which basically the user 4 cannot see includes a plurality of luggage lock mechanisms 51. The plurality of luggage lock mechanisms 51 include wire lock type luggage lock mechanisms $\mathbf{51}a_1$ to $\mathbf{51}a_3$ and a luggage box type luggage lock mechanism 51*b*. Further, in the example shown in FIG. 4, the luggage lock mechanisms $\mathbf{51}a_1$ and $\mathbf{51}a_2$ are locked in the state with luggage 4*a* of the user 4 stored. Further, each luggage lock mechanism 51 is provided with a recognition device 52 and HMI 53.

Configuration of Server

Figure 5:
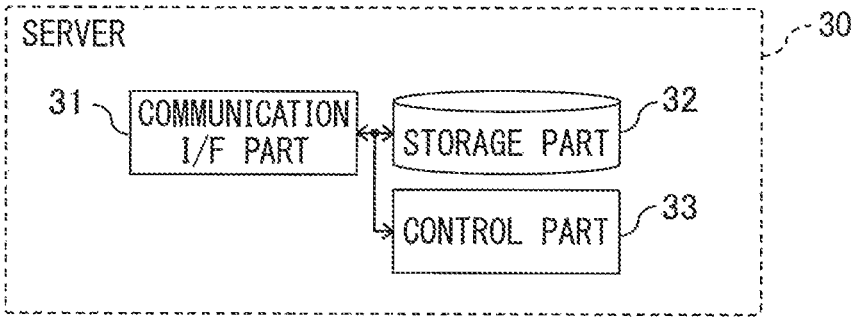
FIG. 5 is a schematic view of the configuration of a server according to one embodiment.

FIG. 5 is a schematic view of the configuration of the server 30 according to the present embodiment. As shown in FIG. 5, the server 30 includes a communication I/F part 31, storage part 32, and control part 33, which are connected with each other through signal wires.

The communication I/F part 31 is one example of a communication part and is a communication I/F circuit for connecting the server 30 with the network 5. The communication I/F part 31 is configured to be able to communicate with an in-vehicle device 3 of a vehicle 2 and a mobile terminal 40 through the network 5.

The storage part 32, for example, can be provided with a ROM (read only memory), RAM (random access memory), etc. The storage part 32 stores the various programs and various data (for example, user information, various parameters, various threshold values, etc.) used for processing by the control part 33.

The control part 33, for example, can be a processor having a CPU and its peripheral circuits etc. The control part 33 can run the various programs stored in the storage part 32 to thereby perform the various control operations of the server 30. The control part 33 performs processing relating to the server 30 in the processing for user transport relating to the mobility service explained later using FIG. 7.

Configuration of Mobile Terminal

Figure 6:
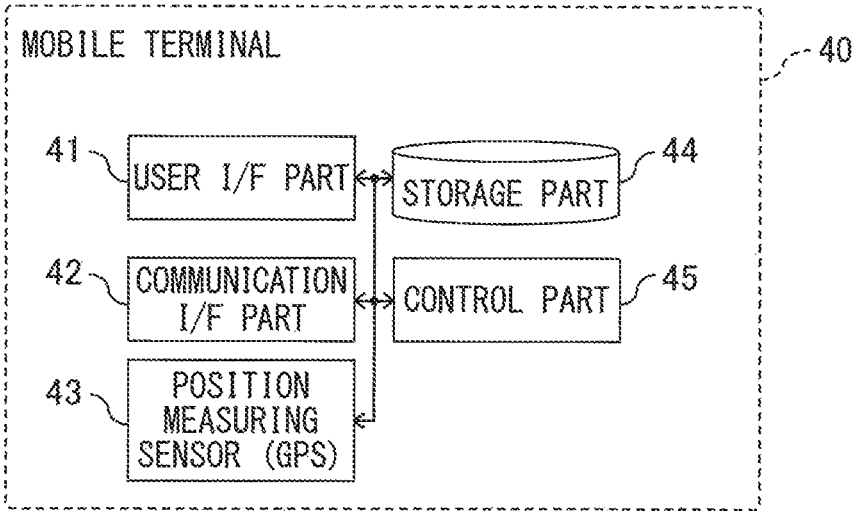
FIG. 6 is a schematic view of the configuration of a mobile terminal according to one embodiment.

FIG. 6 is a schematic view of the configuration of a mobile terminal 40 according to the present embodiment. The mobile terminal 40 includes a user I/F part 41, communication I/F part 42, position measuring sensor 43, storage part 44, and control part 45. The mobile terminal 40 is held by the user 4 and can move together with the user 4.

The user I/F part 41, for example, has a touch panel display. The user I/F part 41 generates a signal corresponding to an operation at the mobile terminal 40 by the user (for example, startup of application relating to mobility service, acceptance of shared ride with other users, etc.) and outputs that signal to the control pail 45. Further, the user I/F part 41 displays various information for display use received from the control part 45 (for example, message proposing shared ride with other user, information for identifying vehicle such as license plate number of get-on vehicle, get-on location, get-on time, etc.).

The communication I/F part 42 is one example of a communication part and is a communication I/F circuit for connecting the mobile terminal 40 with the network 5. The communication I/F part 42 is configured to be able to communicate with an in-vehicle device 3 of the vehicle 2 and a server 30 through the network 5.

The position measuring sensor 43 generates position information indicating the current location of the mobile terminal 40 and outputs it to the control part 45. The position measuring sensor 43 is, for example, a GPS. The position measuring sensor 43 generates position information indicating the current location of the mobile terminal 40 and outputs it to the control part 45.

The storage part 44, for example, can include a ROM (read only memory), RAM (random access memory), etc. The storage part 44 stores the various programs and various data (for example, various parameters, various threshold values, etc.) used for processing by the control part 45.

The control part 45, for example, can be a processor having a CPU and its peripheral circuits etc. The control part 45 can run the various programs stored in the storage part 44 to thereby perform the various control operations of the mobile terminal 40. The control part 45 performs processing relating to the mobile terminal 40 in the processing for user transport relating to the mobility service explained later using FIG. 7.

Summary of Processing for User Transport

Figure 7:
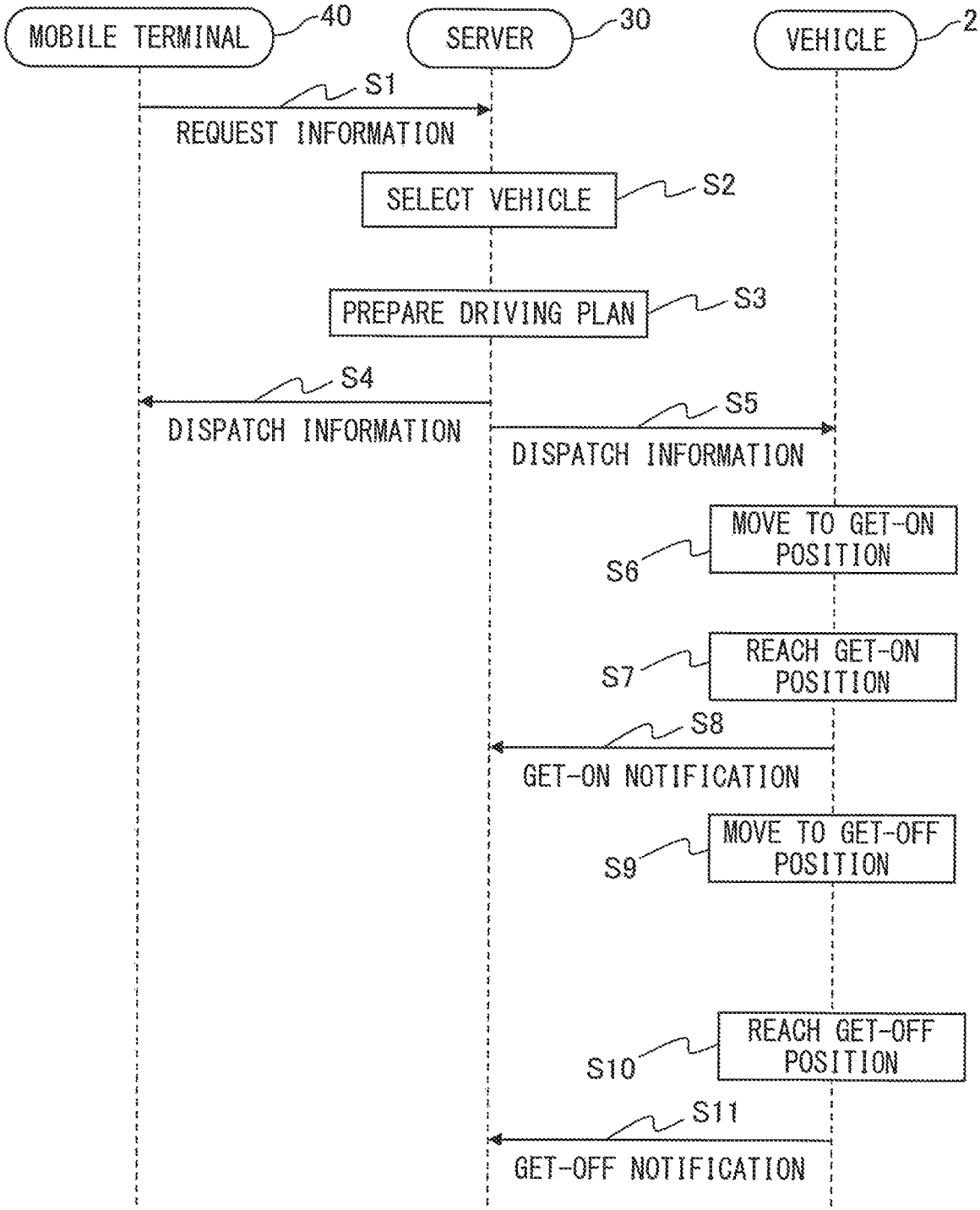
FIG. 7 is a sequence diagram showing one example of processing for control of user transport in the user transport system according to one embodiment.

FIG. 7 is a sequence diagram showing one example of processing for user transport relating to a mobility service in the user transport system 1 according to the present embodiment. In the sequence diagram shown in FIG. 7, communication between an in-vehicle device 3 of a vehicle 2 and a server 30 and mobile terminal 40 is performed through a network 5.

A user utilizing a mobility service uses a mobile terminal 40 etc. to register user information in advance. The registered user information is stored in the storage part 32 of the server 30 for each user. When requesting utilization of the mobility service, that is, when requesting dispatch of the vehicle 2, the user operates the mobile terminal 40 to enter the request information in the mobile terminal 40. The request information is input on, for example, an application for mobility service use installed in the mobile terminal 40.

If the user 4 trying to utilize the mobility service operates his or her held mobile terminal 40 to enter request information into the mobile terminal 40, at step S1, the mobile terminal 40 sends request information to the server 30. The request information includes, for example, the current location of the user 4, the destination of the user 4, identification information for identifying the user 4 (for example, registration number of the user 4 etc.), shared rider information (number of shared riders etc.), type of luggage lock mechanism 51 desired to be used (for example, wire lock type, luggage box type, etc.) etc. Further, the current location and destination of the user 4 are, for example, designated by the name of the facility, address, or combination of longitude and latitude. Note that, the request information may include the desired get-on position of the user 4 instead of including the current location of the user 4.

If the server 30 receives request information from the user 4 through the mobile terminal 40, at step S2, the server 30 selects the vehicle 2 suited for transport of the user 4. That is, the server 30 matches the user with a vehicle 2. The vehicle 2 suited for transport of the user is, for example, a vehicle 2 standing by nearest the current location.

At step S3, the server 30 prepares a driving plan for transporting the user 4. The driving plan includes the get-on position where the user 4 gets on the vehicle 2, the get-off position where the user 4 is to get off the vehicle 2, the scheduled time of arrival at the get-on position, the driving route to the get-off position, the scheduled time of arrival at the get-off position, etc.

At step S4, the server 30 sends the dispatch information to the mobile terminal 40. The dispatch information sent to the mobile terminal 40 includes the get-on position, get-off position, scheduled time of arrival at the get-on position, driving route to the get-off position, scheduled time of arrival at the get-off position, identification information of the vehicle 2 (license plate number, car model, color, etc.), etc. Further, at step S5, the server 30 sends the dispatch information to the vehicle 2. The dispatch information sent to the vehicle 2 includes the get-on position, get-off position, driving route to the get-off position, identification information of the user 4, type of luggage lock mechanism 51 desired to be used, etc.

If at step S6 the vehicle 2 receives dispatch information from the server 30, the self-driving ECU 10 controls the vehicle 2 for automated driving to thereby start movement of the vehicle 2 to the get-on position. After that, at step S7, the vehicle 2 reaches the get-on position and the vehicle 2 stops.

If the user 4 gets on the dispatched vehicle 2 and, for example, the mobile terminal 40 is made to communicate with the get-on/get-off detector 54 by short range wireless communication, at step S8, the vehicle 2 detects that the user 4 has gotten on the vehicle 2 based on the detection signal output by the get-on/get-off detector 54 and notifies the server 30 that the user 4 has gotten on the vehicle. Note that, instead of the in-vehicle device 3 of the vehicle 2 notifying that the user 4 has gotten on the vehicle 2, the user 4 himself or herself may operate the mobile terminal 40 to notify having gotten on the vehicle.

At this time, if desiring to utilize a luggage lock mechanism 51, the user 4 stows the luggage 4*a* in the luggage lock mechanism 51. After that, the luggage lock mechanism 51 is locked.

At step S9, the self-driving ECU 10 controls the vehicle 2 for automated driving to thereby start the vehicle 2 moving to the get-off position. While the vehicle 2 is moving to the get-off position, the vehicle 2, for example, periodically sends the server 30 the position information indicating the current location of the vehicle 2 or the surrounding information of the vehicle 2 etc. After that, at step S10, the vehicle 2 reaches the get-off position and vehicle 2 stops. If the vehicle 2 reaches the get-off position and stops, the luggage lock mechanism 51 is unlocked. The user 4 takes out the stowed away luggage from this unlocked luggage lock mechanism 51.

When the user 4 get off vehicle 2, for example, if making the mobile terminal 40 communicate with the get-on/get-off detector 54 by short range wireless communication, at step S11, the vehicle 2 detects that the user 4 has gotten off based on a detection signal output from the get-on/get-off detector 54 and notifies the server 30 that the user 4 has gotten off the vehicle. Note that, instead of the in-vehicle device 3 of the vehicle 2 notifying that the user 4 has gotten off the vehicle 2, the user 4 himself or herself may operate the mobile terminal 40 to notify having gotten off the vehicle.

If the above mentioned such series of services ends, the vehicle 2 enters a standby state for transport of the next user or moves to the get-on position for the next user.

Problem

In this regard, in an automated driving vehicle utilized for a plurality of users, as shown in FIG. 4, sometimes pieces of luggage 4*a* of the users 4 are carried at a place not able to be watched by the users 4. For this reason, when a user 4 get off, the gotten off user 4 is liable to end up mistakenly or deliberately carrying off the luggage 4*a* of another user 4.

Therefore, to keep luggage from being carried off in this way, a luggage lock mechanism 51 stores luggage 4*a* so that in the locked state the luggage 4*a* is restricted from being taken out. For example, at the time of get-on, the user 4 stows the luggage 4*a* at the luggage lock mechanism 51, then locks the luggage lock mechanism 51 to keep the luggage 4*a* from being carried off in this way.

However, to keep luggage from being carried off in this way, when the user 4 unlocks the luggage lock mechanism 51 so as to take out the luggage 4*a*, the user 4 is asked to perform some sort of operation such as for example entering a PIN or holding the mobile terminal 40 against a reading device. If always requesting such an operation from the user 4, time ends up being taken for the user 4 to take out the luggage 4*a*.

Automatic Unlocking Upon Arrival at Destination

Therefore, in the present embodiment, when the vehicle 2 reaches the destination of a user 4, the luggage lock control part 24 unlocks the luggage lock mechanism 51 at which the user 4 reaching the destination had stored his or her luggage 4*a*. According to the present embodiment, at the time of get-off, the trouble of the user 4 required for taking out the luggage 4*a* can be reduced, so the convenience of the luggage lock system mounted in the vehicle 2 can be improved. Below, the luggage lock system according to the present embodiment will be explained in detail.

Flowchart

Figure 8:
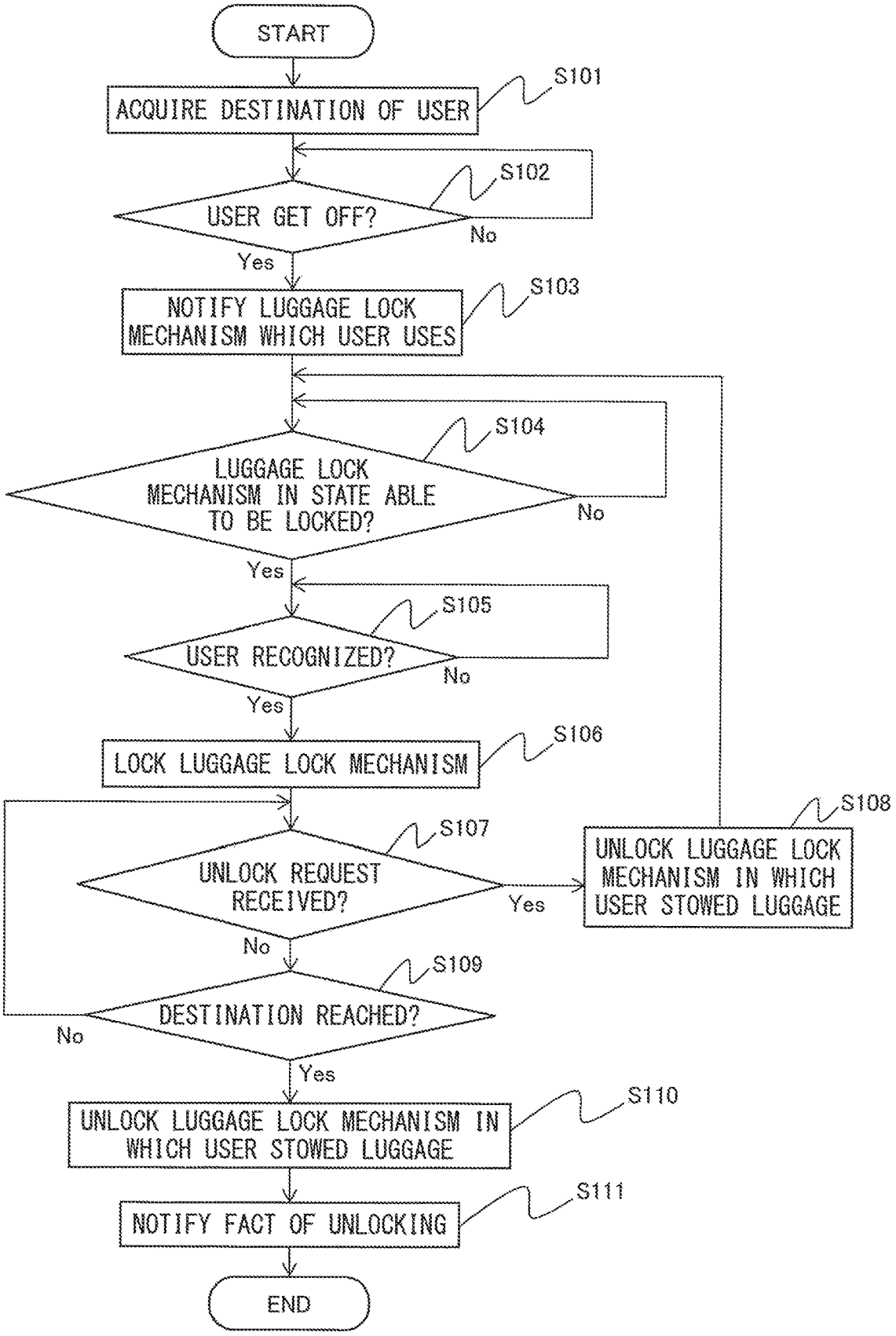
FIG. 8 is a flow chart showing a control routine in the luggage lock system according to one embodiment.

FIG. 8 is a flow chart showing a control routine in a luggage lock system according to the present embodiment. The flow of the present control routine is realized by the processor of the control part 23 of the in-vehicle device 3 running a program stored in the storage part 22 of the in-vehicle device 3. The present control routine is performed, for example, by the control part 23 of the in-vehicle device 3 after the above step S1 at FIG. 7, that is, if the in-vehicle device 3 receives request information.

At step S101, the destination of a user 4 is acquired at the acquiring part 25. The destination of this user 4 is, for example, included in the dispatch information sent from the server 30 at step S1 of FIG. 7. The acquiring part 25 acquires the destination of the user 4 from the request information received from the server 30 through the vehicle outside communication device 55. The storage part 22 stores the destination of the user 4 acquired at the acquiring part 25 linked with the user 4.

Next, at step S102, it is determined if the user 4 scheduled to get on has gotten on vehicle 2. Such a determination is performed, for example, based on a detection signal output from the get-on/get-off detector 54. If at step S102 it is determined that the user 4 has gotten on the vehicle 2, the present control routine proceeds to step S103. On the other hand, if at step S102 it is determined that the user 4 has not gotten on the vehicle 2, step S102 is repeated.

At step S103, the notifying part 27 notifies the gotten on user 4 of the luggage lock mechanism 51 to be used by that user 4. The notifying part 27, for example, displays at the HMI 53 provided close to the door for get-on/get-off in the vehicle the identification number of that luggage lock mechanism 51 and the use of the luggage lock mechanism 51 of that identification number. Further, the notifying part 27 may, for example, transmit notification information for providing this notification through the server 30 to the mobile terminal 40 to thereby make this information be displayed at the user I/F part 41 of the mobile terminal 40. By this notification of the luggage lock mechanism 51 to be used, the user 4 can learn of the luggage lock mechanism 51 to use. For this reason, the user 4 can smoothly stow the luggage 4*a* in the luggage lock mechanism 51 and the luggage lock mechanism 51 assigned to that user 4 can be kept from being used by another user 4 even if a plurality of the users 4 simultaneously get on.

Here, a gotten-on user 4 is, for example, assigned with a luggage lock mechanism 51 to be used by that user 4 in advance. The luggage lock mechanism 51 to be used by this user 4 is, for example, determined from among the luggage lock mechanisms 51 other than the luggage lock mechanisms 51 which were assigned to currently riding users 4 in the rising order of the identification numbers of the luggage lock mechanisms 51. Further, for example, if the dispatch information received by the in-vehicle device 3 includes information relating to the type of luggage lock mechanism 51 desired to be used, the luggage lock mechanism 51 to be used by this user 4 may be determined with priority from this type of luggage lock mechanism 51.

Note that, if the user 4 requests to use a luggage lock mechanism 51 different from the notified luggage lock mechanism 51, for example, the user 4 may designate the luggage lock mechanism 51 desired to be used through the HMI 53 provided near the door for get-on/get-off of the inside of the vehicle or the recognition device 52. If not a state where the designated luggage lock mechanism 51 cannot be used (for example, during current use by another user etc.), that designated luggage lock mechanism 51 is assigned as the luggage lock mechanism 51 to be used by the user 4.

At step S104, it is determined if the luggage lock mechanism 51 notified at step S103 is in a state able to be locked. For example, for a wire lock type luggage lock mechanism 51, it is determined that the luggage lock mechanism 51 is in a state to be able to be locked if the two ends of the wire are coupled. Further, for example, for a luggage box type luggage lock mechanism 51, it is determined that the luggage lock mechanism 51 is in a state able to be locked if the door is closed.

If at step S104 it is determined that the luggage lock mechanism 51 is in a state able to be locked, the present control routine proceeds to step S105. On the other hand, if at step S104 it is determined that the luggage lock mechanism 51 is not in a state able to be locked, step S104 is repeated. Note that, if it is determined that the luggage lock mechanism 51 is not in a state able to be locked, the notifying part 27 may provide notification seeking that the luggage lock mechanism 51 be rendered a state able to be locked through the HMI 53 provided near that recognition device 52.

Next, at step S105, in the recognizing part 26, it is determined whether the user 4 has been recognized by the recognition device 52 corresponding to the luggage lock mechanism 51 assigned to the gotten on user 4. The recognition of the user 4 by this recognition device 52 is performed by a known method. Specifically, the recognition device 52 can recognize the user 4, for example, by the user 4 holding the mobile terminal 40 against the reader for wireless communication with the mobile terminal 40 and by reading the ID of the user 4 or other recognition information of the user 4. Further, the recognition device 52 may also, for example, recognize the user 4 by reading the code information for user recognition displayed on the mobile terminal 40 or the fingerprint or other biometric information of the user 4. By the recognition device 52 recognizing the user 4 in this way, it is possible to keep a luggage lock mechanism 51 not assigned to a user 4 from being used by that user even if a plurality of users 4 simultaneously get on.

A recognition device 52 is provided for every luggage lock mechanism 51 so as to correspond to the luggage lock mechanism 51. For this reason, the recognizing part 26 recognizes the user 4 recognized by the recognition device 52 as the user 4 stowing luggage 4*a* in the luggage lock mechanism 51 corresponding to that the recognition device 52. As a result, the recognizing part 26 recognizes the user 4 stowing luggage 4*a* in the luggage lock mechanism 51 and the luggage lock mechanism 51 in which the user 4 stowed the luggage 4*a*. The storage part 22 stores the users 4 and the luggage lock mechanisms 51 recognized by the recognizing pan 26 linked together.

In this way, by the recognizing part 26 recognizing the user 4 and luggage lock mechanism 51, for example, if a plurality of users 4 has gotten on the vehicle 2, at the later explained step S109, it becomes possible to keep the luggage lock mechanism 51 storing luggage 4*a* of another user 4 not the user 4 reaching the destination from being unlocked.

If at step S105 it is determined that the user and the luggage lock mechanism have been recognized, the present control routine proceeds to step S106. On the other hand, if at step S105 it is determined that the user and the luggage lock mechanism have not been recognized, step S105 is repeated.

At step S106, the luggage lock control part 24 outputs a luggage lock signal to the luggage lock mechanism 51 determined to have been recognized at step S105. Receiving this luggage lock signal, the luggage lock mechanism 51 is locked. After that, the present control routine proceeds to step S107.

At step S107, it is determined if an unlock request for unlocking the luggage lock mechanism 51 in which the user 4 has stowed the luggage 4*a* has been received from the mobile terminal 40 of the user 4. This unlock request is, for example, sent from the mobile terminal 40 through the server 30 or by wireless communication between the mobile terminal 40 and the in-vehicle device 3 to the in-vehicle device 3 in response to operation of the mobile terminal 40 by the user 4.

If at step S107 it is determined that an unlocking request has been received, the present control routine proceeds to step S108. On the other hand, if it is determined at step S107 that no unlocking request has been received, the routine proceeds to step S109.

At step S108, the luggage lock control part 24 outputs a luggage unlock signal to the luggage lock mechanism 51 in which the user 4 who requested unlocking had stowed luggage 4*a*. Receiving this luggage unlock signal, the luggage lock mechanism 51 is unlocked. Therefore, according to steps S107 and S108, it can be said that when receiving a request for unlocking sent from the mobile terminal 40, the luggage lock control part 24 unlocks the luggage lock mechanism 51 in which the user 4 had stowed the luggage 4*a* even before the vehicle 2 reaches the destination of the user 4. As a result, even before reaching the destination of the user 4, the user 4 can take out luggage 4*a* from the luggage lock mechanism 51 in which the user 4 had stowed luggage 4*a* when needed.

After step S108, the present control routine returns to step S104. Here, if in this way the control routine returns to step S104, the recognition of the user by the recognition device 52 at step S105 may also be omitted. In this ease, the control routine may proceed to step S106 if, for example, after the unlocking at step S108, the user 4 again stows the luggage 4*a* at the luggage lock mechanism 51, it is determined at step S104 that the luggage lock mechanism 51 is in a state able to be locked, then the luggage lock control part 24 receives a lock instruction for locking the luggage lock mechanism 51 input by the user 4 through the HMI 53 provided near the recognition device 52. Alternatively, the control routine may also proceed to step S106 if, for example, after the luggage lock mechanism 51 is rendered a state not able to be locked (for example, ends of wires are disconnected, the luggage box is opened, etc.) at the same time as unlocking at step S108, the user 4 again stows the luggage 4*a* at the luggage lock mechanism 51 and at step S104 it is determined that the luggage lock mechanism 51 is in a state able to be locked.

At step S109, it is determined if the user 4 has reached its destination. This determination is performed based on the destination of the user 4 acquired at the acquiring part 25. If at step S109 it is determined that the destination has been reached, the present control routine proceeds to step S110. On the other hand, if at step S109 it is determined that the destination has not been reached, the present control routine returns to step S107.

At step S110, the luggage lock control part 24 outputs a luggage unlock signal to the luggage lock mechanism 51 in which the user 4 reaching the destination had stowed its luggage 4*a*. Receiving this luggage unlock signal, the luggage lock mechanism 51 is unlocked. Specifically, the luggage lock control part 24 searches for the luggage lock mechanism 51 in which the user 4 reaching the destination stowed luggage 4*a* based on the user 4 and the luggage lock mechanism 51 recognized by the recognizing pan 26 and outputs a luggage unlock signal to the found luggage lock mechanism 51. Note that, if a luggage lock mechanism 51 in which a user 4 other than the user 4 reaching the destination stows luggage 4*a* is also locked, that luggage lock mechanism 51 may not be unlocked and only the luggage lock mechanism 51 in which the user 4 reaching the destination has stowed luggage 4*a* may be unlocked. After step S110, the present control routine proceeds to step S111.

At step S111, the notifying part 27 notifies the user 4 arriving at the destination that the luggage lock mechanism 51 in which the user stowed the luggage has been unlocked. Specifically, the notifying part 27, for example, displays, at the HMI 53 provided at the seat of the user 4 reaching the destination, the identification number of the luggage lock mechanism 51 and the fact that the luggage lock mechanism 51 of that identification number has been unlocked. Further, the notifying part 27, for example, may send notification information for providing this notification through the server 30 to the mobile terminal 40 to thereby make the user I/F part 41 of the mobile terminal 40 display this information. As a result, the user 4 can be prompted to take out his or her luggage 4*a* and the user 4 can be kept from ending up being gotten off while leaving the luggage stowed at the luggage lock mechanism 51.

After step S111, the present control routine ends.

Further, in the present embodiment, the luggage lock mechanism 51 to be used by the user 4 was assigned in advance, but the luggage lock mechanism 51 used by the user 4 may also not be assigned in advance. In this case, the user can, for example, freely select the luggage lock mechanism 51 to be used. Specifically, for example, at the time of get-on, the user 4 may also designate the luggage lock mechanism 51 which it desires to use through the HMI 53. Alternatively, the user 4 may be recognized by the recognition device 52 corresponding to the luggage lock mechanism 51 which it desires to use whereby the luggage lock mechanism 51 corresponding to that recognition device 52 may be determined as the luggage lock mechanism 51 to be used by the user 4.

Further, in the present embodiment, a recognition device 52 is provided for each luggage lock mechanism 51, but the recognition device 52 need not be provided for every luggage lock mechanism 51. In this case, for example, a single recognition device 52 may be used for recognition of a user 4 stowing luggage at each luggage lock mechanism 51.

REFERENCE SIGNS LIST 2. vehicle
3. in-vehicle device
10. self-driving ECU
20. luggage-locking ECU
24. luggage lock control part
25. acquiring part
26. recognizing part
27. notifying part
30. server
40. mobile terminal

The invention claimed is:

1. A luggage lock device comprising:

a plurality of luggage lock mechanisms able to store luggage of a user of a vehicle so that when locked, the luggage is restricted from being taken out; and a luggage lock control device connected to the plurality of luggage lock mechanisms, the luggage lock control device being configured to:

control the plurality of luggage lock mechanisms;

acquire a destination of a user;

recognize a user who stowed luggage in the luggage lock mechanism and the luggage lock mechanism in which the user stowed the luggage;

determine whether the vehicle has arrived at the destination of the user; and upon determination that the vehicle has arrived at the destination of the user, unlock a luggage lock mechanism storing luggage of the user.

2. The luggage lock device according to claim 1, wherein the luggage lock device further comprises a recognition device recognizing the user, the recognition device is provided so as to correspond to each luggage lock mechanism, and the luggage lock control device is configured to recognize a user recognized by the recognition device as a user storing luggage in a luggage lock mechanism corresponding to the recognition device.

3. The luggage lock device according to claim 1, wherein the luggage lock device further comprises a communication device configured to be able to communicate with a mobile terminal of the user, and the luggage lock control is configured, when receiving an unlock request sent from the mobile terminal of the user through the communication device, to unlock the luggage lock mechanism in which the user stowed the luggage even before the vehicle reaches the destination of the user.

4. The luggage lock device according to claim 1, wherein the luggage lock control device is configured to notify a user reaching the destination of the fact of the luggage lock mechanism storing the luggage of the user reaching the destination being unlocked, when the vehicle has reached the destination of the user.

5. A method for controlling a plurality of luggage lock mechanisms able to store luggage of a user of a vehicle so that when locked, the luggage is restricted from being taken out, the method comprising steps of:

acquiring a destination of the user;

recognizing a user who stowed luggage in the luggage lock mechanism and the luggage lock mechanism in which the user stowed the luggage;

determining whether the vehicle has arrived at the destination of the user; and upon determination that the vehicle has arrived at the destination of the user, unlocking a luggage lock mechanism storing luggage of the user.

6. The method of claim 5, further comprising recognizing the user with a recognition device, the recognition device being provided so as to correspond to each luggage lock mechanism, and recognizing the user recognized by the recognition device as a user storing luggage in a luggage lock mechanism corresponding to the recognition device.

7. The method of claim 5, further comprising communicating with a mobile terminal of the user, and when receiving an unlock request sent from the mobile terminal of the user, unlocking the luggage lock mechanism in which the user stowed the luggage even before the vehicle reaches the destination of the user.

8. The method of claim 5, further comprising notifying a user reaching the destination of the fact of the luggage lock mechanism storing the luggage of the user reaching the destination being unlocked, when the vehicle has reached the destination of the user.

* * * * *